US007951054B2

(12) United States Patent
Snow et al.

(10) Patent No.: US 7,951,054 B2
(45) Date of Patent: May 31, 2011

(54) REHABILITATION AND EXERCISE APPARATUS

(75) Inventors: Donna Snow, New Castle, PA (US); Robert Ayres, Wilmington, PA (US)

(73) Assignee: Lifting Up Life, LP, West Wilmington, PA (US)

( * ) Notice: Subject to any disclaimer, the term of this patent is extended or adjusted under 35 U.S.C. 154(b) by 135 days.

(21) Appl. No.: 12/258,697

(22) Filed: Oct. 27, 2008

(65) Prior Publication Data

US 2009/0111660 A1 Apr. 30, 2009

Related U.S. Application Data

(60) Provisional application No. 60/982,846, filed on Oct. 26, 2007, provisional application No. 61/014,822, filed on Dec. 19, 2007, provisional application No. 61/086,608, filed on Aug. 6, 2008.

(51) Int. Cl.
*A63B 21/00* (2006.01)

(52) U.S. Cl. ..... 482/136; 482/137; 482/148; 482/34

(58) Field of Classification Search ..... 482/136, 482/137, 148, 34, 79, 80
See application file for complete search history.

(56) References Cited

U.S. PATENT DOCUMENTS

| | | | | |
|---|---|---|---|---|
| 189,356 | A | 4/1877 | Hanson et al. | |
| 1,623,670 | A | 4/1927 | Frankenfeld | |
| 1,705,745 | A | 3/1929 | Anderson | |
| 2,223,309 | A | 11/1940 | Swanson | |
| 4,373,716 | A | 2/1983 | Pagani | |
| 4,403,773 | A | 9/1983 | Swann | |
| 4,494,662 | A | 1/1985 | Clymer | |
| 4,757,993 | A | 7/1988 | Rake | |
| 4,863,163 | A | 9/1989 | Wehrell | |
| 5,399,140 | A * | 3/1995 | Klippel | 482/146 |
| 5,433,690 | A * | 7/1995 | Gilman | 482/146 |
| 6,213,924 | B1 * | 4/2001 | Kaiyoorawongs | 482/146 |
| 6,743,152 | B2 | 6/2004 | Weiss | |
| 7,465,262 | B2 * | 12/2008 | Ho | 482/146 |
| 2005/0043143 | A1 * | 2/2005 | Chuang | 482/51 |
| 2005/0170939 | A1 * | 8/2005 | Lin | 482/148 |

* cited by examiner

*Primary Examiner* — Jerome W Donnelly
(74) *Attorney, Agent, or Firm* — Barlow, Josephs & Holmes, Ltd.

(57) ABSTRACT

A therapeutic and/or exercise apparatus is provided for use in connection with structured, multiaxial, multi-pattern movement that aids in rehabilitation or enhances conditioning. The apparatus generally includes a base and a posture bar that is attached to and extends upwardly from the base. The posture bar is affixed to a top surface of the base and can be removable or collapsible for ease of storage. The top surface of the base also includes a recess therein for receiving one of a variety of controlled motion devices such as a rotary disk that moves freely or is restrained by resistance means or other proprioceptive tools. This feature provides a much more balanced exercise process while also naturally working the entire set of muscle groups related to the exercise rather than simply isolating a single motion or muscle.

9 Claims, 5 Drawing Sheets

REHABILITATION AND EXERCISE APPARATUS

CROSS-REFERENCE TO RELATED APPLICATIONS

This application is related to and claims priority from earlier filed U.S. Provisional Patent Application No. 60/982,846 filed Oct. 26 2007; earlier filed U.S. Provisional Application No. 61/014,822 filed Dec. 18 2007; and earlier filed U.S. Provisional Application No. 61/086,608 filed Aug. 6 2008.

BACKGROUND OF THE INVENTION

The present invention relates generally to a device for use in connection with rehabilitation therapy and general exercise. More specifically the present invention relates to a collapsible exercise platform that includes an interchangeable user interface mounted within its base platform that facilitates proper exercise posture and positioning while simultaneously working a broad range of muscle groups.

It is well known in the art that therapeutic exercise is important and is widely accepted as a means for treating and relieving a variety of human disabilities. Additionally exercise plays a crucial role in the rehabilitation of patients suffering from various injuries. A physical therapist's role in such a rehabilitative context is to provide rehabilitative professional care that individually tailors exercise programs to meet a patient's needs. These tailored rehabilitative exercise programs differ depending on the type and amount of damage to the injured area stage of tissue healing age of the person and prior level of function of the individual prior to injury.

Some of the most common early rehabilitation methods consist of isometric exercise continuous passive motion (CPM) machines and/or active assisted range of motion (ROM) performed by a therapist on a patient. While isometric exercise is a good way to initiate strength into newly repaired tissue the benefits are limited in that such fixed motion therapies as are provided through CPM are too concentrated requiring that ROM exercises also be implemented in order for the patient to normal or pre-surgical levels of movement. The problem with therapist implemented ROM however is that such therapy is labor intensive costly and infrequent. This then requires a return to a set of limited exercises being given to patients for a home program that consists usually but not solely of isometric muscle setting exercises. These exercises generally do not involve sufficient ranges of joint movement and therefore have limited benefit in the rehabilitative setting. Additionally exercises that are usually instituted later in the rehabilitation process utilize a resistive band and may provide less stability to the joint making them generally less comfortable therefore usually yielding less patient compliance. Finally patients may be given a variety of exercises that involve open and closed chain activity. These can place an unwanted compressive or shear force on the joints should they be performed incorrectly.

In other contexts beyond rehabilitative therapy regular exercise is also known to keep the body in good shape but not all such exercise is equally effective. In fact many of the exercise devices that are marketed or provided in health and athletic clubs are actually less effective than people realize. That is not to say that the majority of the exercise equipment that is provided in health clubs is not beneficial provided that the user gets proper instruction under the guidance of a trainer. The primary issue is that most of the equipment employed in health clubs trains using predominantly linear single plane movement and as a result is limited to isolating one muscle group while allowing other muscle groups to rest. Examples of this type of exercise can be put into two categories. The first is the leg press a closed chain activity and the second exercise is the leg extension which is an open chain exercise. Generally neither of these exercises is considered ideal for knee or hip rehabilitation. While this type of training may be appropriate for an athlete or one who has a balanced workout regimen this type of isolated open chain planar movement is not how the body typically moves in reality.

Ultimately in either of the rehabilitative or exercise contexts it must be understood that the body rarely moves in just one plane. Often the body must employ multiple muscle groups and balance them in a cooperative fashion to reach the desired end result. Further most body movement involves rotation and diagonal patterns of movement. For example taking a step requires combined movements of plantar flexion internal hip rotation foot pronation/supination knee extension and hip extension. The difficulty of the overall problem can be seen in the fact that if the human body only moved in single planes it would be easy to construct a mechanical hand foot or leg that mirrors human movement. However it is very difficult to replicate such realistic human movement because it is not defined through such one or two-dimensional movements.

The complex nature of human movement has created a specialized field of Proprioceptive Neurofacilitation (PNF) within physical medicine. PNF believes that the best form of rehabilitation for musculoskeletal injuries is implemented using diagonal patterns through multiple planes of movement. However this treatment technique requires a purely hands-on manual approach and is extremely demanding of therapist skill and training. The therapist presently practicing PNF must personally take the patient through the motions and provide appropriate resistance for the patient's need and present physical limitations.

Accordingly there is a need in the therapeutic and/or conditioning exercise equipment art for an apparatus that provides structured multiaxial multi-pattern movement that aids in rehabilitation or enhances conditioning. Further there is a need for an apparatus that provides structured multiaxial multi-pattern movement that would allow the patient to control for different muscle patterns and that that can be employed equally by the average healthy person or someone recovering from hip knee or ankle injury. Further still there is a need for a device that enables a user to obtain multidimensional exercise that also provides multiple embodiments and would allow the user to progress toward full rehabilitation through the isolation of muscle groups by mirroring the difficulty and complexity of movement.

BRIEF SUMMARY OF THE INVENTION

In this regard the present invention generally provides a therapeutic and/or exercise apparatus that provides structured multiaxial multi-pattern movement that aids in rehabilitation or enhances conditioning. By using the apparatus of the present invention an average healthy person or a patient recovering from hip knee or ankle injury can equally participate in exercise and rehabilitation activities targeted to different muscle groups and exercise patterns. As a result the apparatus of the present invention enables a user to obtain multidimensional exercise that allows the user to progress toward full rehabilitation through the isolation of muscle groups by mirroring the difficulty and complexity of realistic human movement.

The apparatus of the present invention generally includes a base portion and a posture bar that is attached to and extends upwardly from the base portion. The posture bar is affixed to a top surface of the base portion and can be removable or collapsible for ease of storage. The posture bar serves to assist the user in maintaining correct posture and/or body alignment during exercise activities. The base portion interfaces on a bottom surface with a floor or other stable surface while the top surface includes a recess therein for receiving one of a variety of controlled motion device such as a rotary disk that moves freely or is restrained by resistance means or other proprioceptive tools. This feature of the present invention provides a much more balanced exercise process while also naturally working the entire set of muscle groups related to the exercise rather than simply isolating a single motion or muscle.

The rotary disc may further be enhanced with a locking mechanism that can be released to allow a full 360-degrees of rotational movement or engaged to stop the rotary disc from moving at all. Further the rotary disc may include an indexing mechanism that allows for a specifically defined rotation. For example a turn and click feature allows the disc to be turned over a limited rotation in both internal and external movement.

Finally the present invention provides for attachment points on the base portion that allow various resistive or constant motion assemblies to be attached. In this regard resistive bands pulleys handles cables and various combinations thereof can be attached that are employed in various different exercises while the user is positioned on the base portion. Bands are employed for constant resistive exercises while a single resistance band may be used in combination with one or more pulley to create variable resistance exercises. Further the pulleys and cables may be arranged in a looped manner that allows a constant motion type exercise.

It is therefore an object of the present invention to provide a therapeutic and/or conditioning exercise equipment art for an apparatus that provides structured multiaxial multi-pattern movement that aids in rehabilitation or enhances conditioning. It is a further object of the present invention to provide an apparatus that provides structured multiaxial multi-pattern movement that requires the user to employ a full and free range of motion while performing the required exercises. It is still a further object of the present invention to provide an exercise apparatus invention that results in core strengthening through the use of proprioceptive tools that require that broad ranges of muscles be involved in each exercise rather than simply working targeted muscle groups.

These together with other objects of the invention along with various features of novelty that characterize the invention are pointed out with particularity in the claims annexed hereto and forming a part of this disclosure. For a better understanding of the invention its operating advantages and the specific objects attained by its uses reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
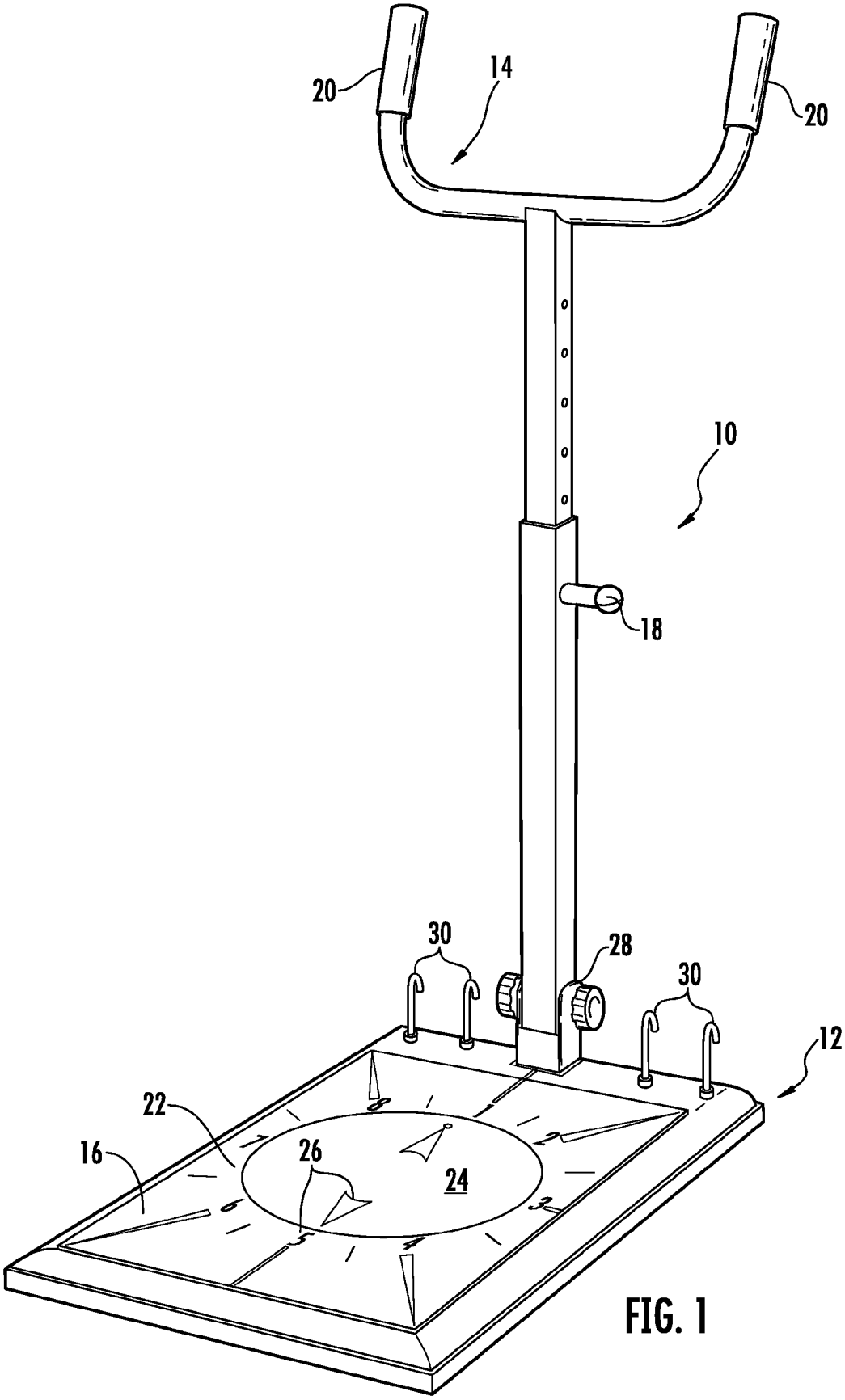
FIG. 1 is a front perspective view of the apparatus of the present invention.
Figure 2:
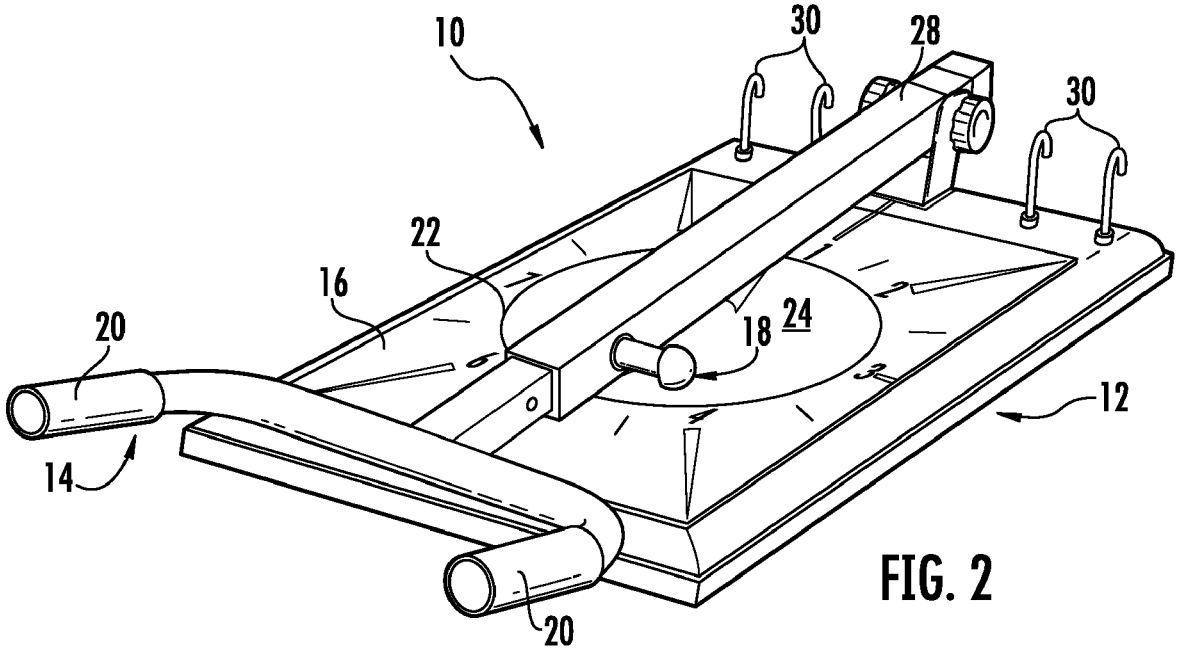
FIG. 2 is a front perspective view of the apparatus of the present invention with the posture bar folded down for storage.
Figure 3:
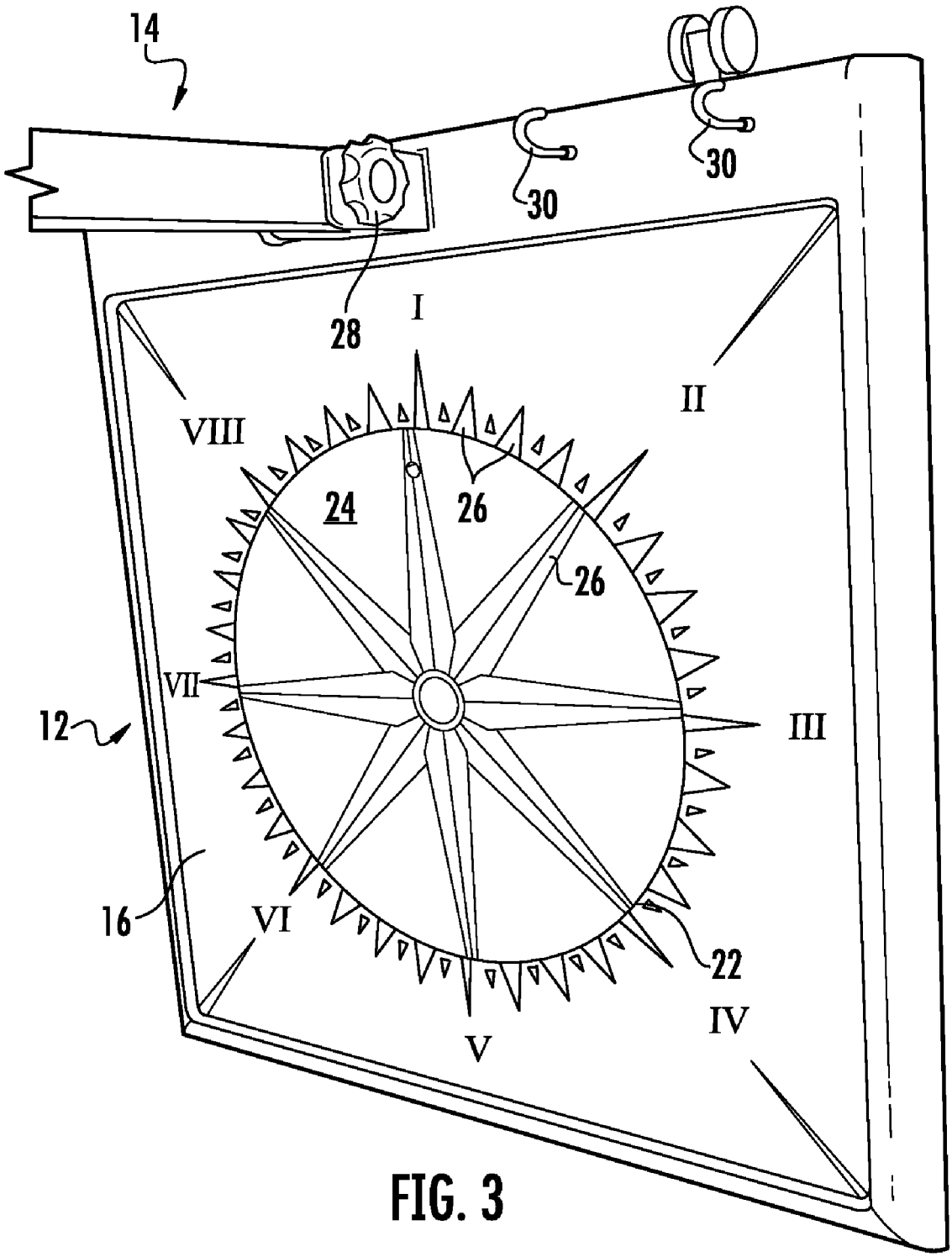
FIG. 3 is perspective view of the base portion of the apparatus of the present invention.
Figure 4:
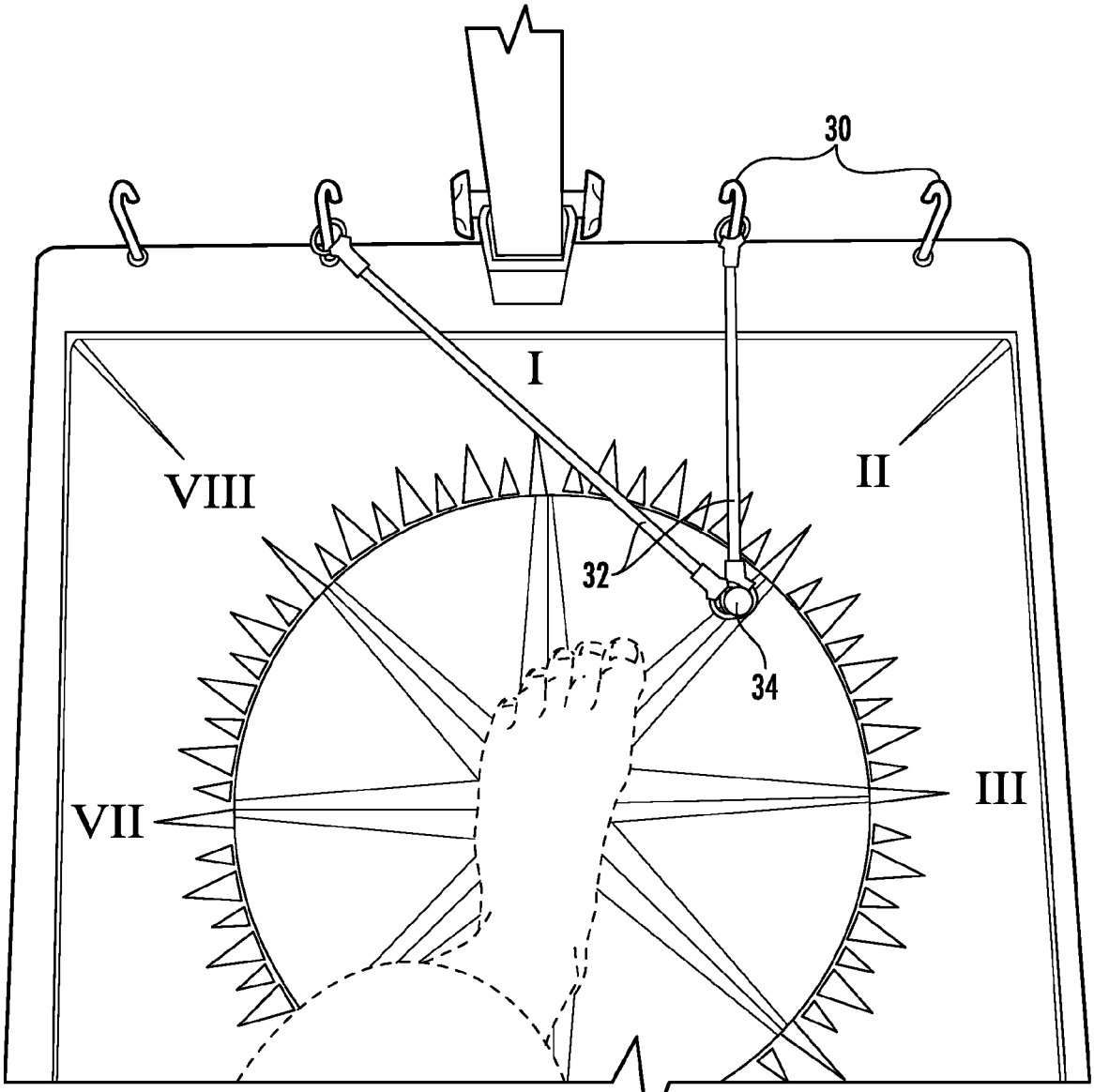
FIG. 4 is a view of the base of the present invention with resistance bands affixed thereto.
Figure 5:
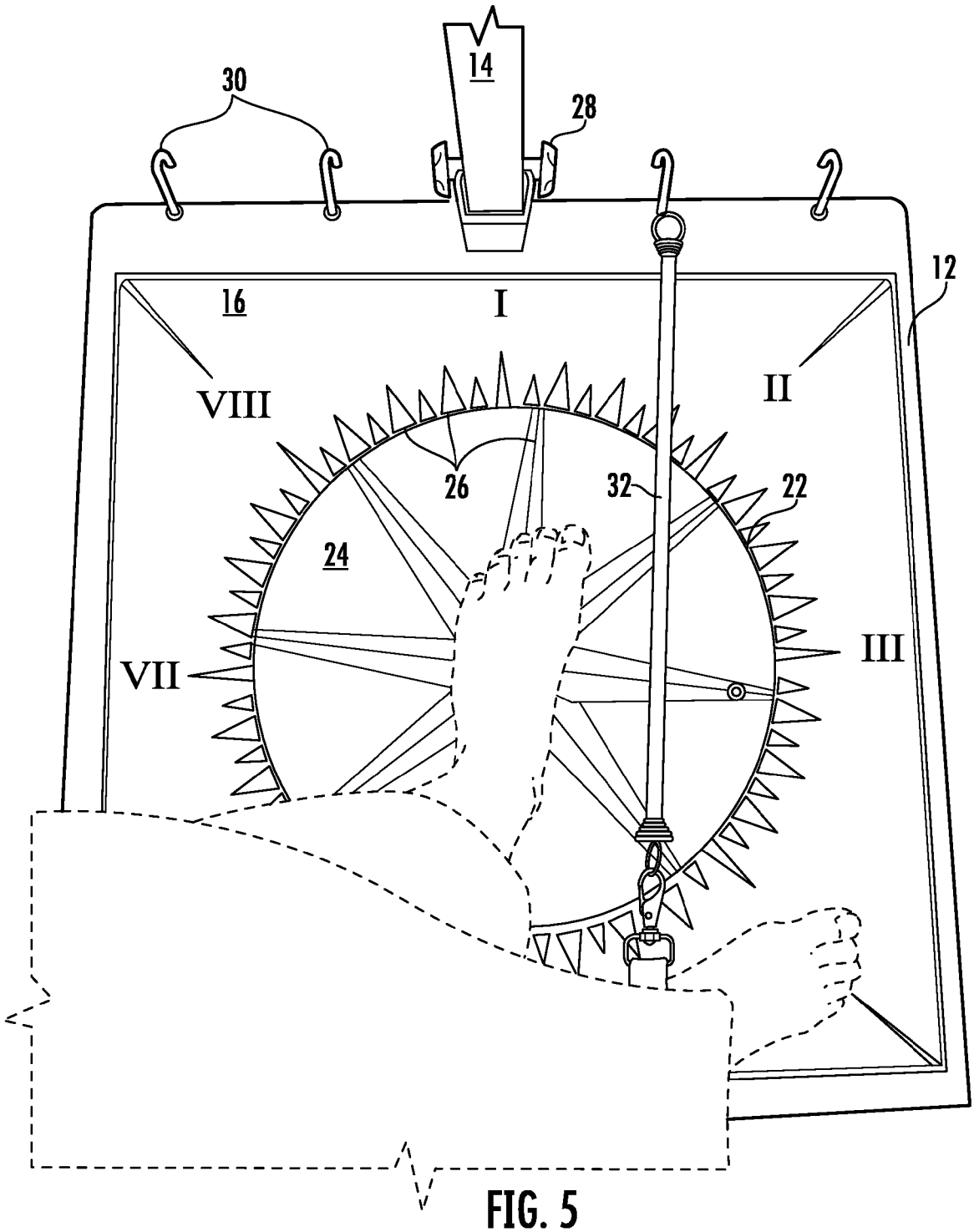
FIG. 5 is a view of the base of the present invention with resistance bands affixed to a user's leg.

Now referring to the drawings the apparatus of the present invention is generally depicted at FIGS. 1 2 and 3 while FIGS. 4 and 5 depict various modes of operation for the apparatus. As can be seen the present invention generally provides a therapeutic and/or exercise apparatus for use in performing structured multiaxial multi-pattern movement that aids in rehabilitation or enhances conditioning. By using the apparatus of the present invention an average healthy person or a patient recovering from hip knee or ankle injury can equally participate in exercise and rehabilitation activities targeted to different muscle groups and exercise patterns. As a result the apparatus of the present invention enables a user to obtain multidimensional exercise that allows the user to progress toward full rehabilitation through the isolation of muscle groups by mirroring the difficulty and complexity of realistic human movement.

Turning to FIGS. 1 and 2 the apparatus 10 of the present invention can be seen to generally include a base portion 12 and a posture bar 14 that is attached to and extends upwardly from the base portion 12. The posture bar 14 is affixed to a top surface 16 of the base portion 12. More preferably the posture bar 14 is affixed to the base portion 14 in a manner that allows it to be easily detached or repositioned for storage. In this regard the posture 14 bar may be fully removable or hingedly attached to the base portion 12 thereby allowing it to be folded against the base portion 12 for storage purposes as seen in FIG. 2. The posture bar 14 is rigidly affixed to the base portion 12 of the present invention and serves as a reliable structural support to assist the user in maintaining correct posture and/or body alignment so that the user can properly execute the various exercise activities. In addition it can be seen that the height of the posture bar 14 is adjustable via the spring biased pin 18 along the side thereof and the handles 20 are ergonomic so that the posture bar 14 facilitates perfect alignment of the user's body and so that it can accommodate users of differing sizes. In operation a user may hold onto the posture bar 14 or lean their front back or side against the posture bar 14 to perform exercises as will be described in more detail below.

The base portion 12 interfaces on a bottom surface with a floor or other stable surface. Ideally the lower surface of the base portion 12 has a sufficiently wide contact surface that allows the base portion 12 to remain stable throughout various exercise activities. Additionally the bottom surface of the base portion 12 may include a nonslip surface to keep the apparatus from sliding across the support surface and may further include small feet to support the four corners of the base portion 12. Further if feet are provided they may be of the leveling type to further enhance the stability of the base portion 12 when used on uneven support surfaces.

The top surface 16 of the base portion 12 includes a recess 22 therein for receiving one of a variety of controlled motion devices. In the preferred embodiment as depicted in the figures the recess 22 can be seen to include a rotary disk 24 installed therein. The rotary disk 24 freely rotates within the recess 22 and relative to the base portion 12. Preferably the rotary disk 24 is received within the recess 22 and is supported by a bearing that enhances the ability of the rotary disk 24 to freely and smoothly rotate. It can also be seen that the rotary disk 24 and base portion 12 include index markings 26 thereon so that the rotary disk 24 is indexed relative to the base portion 12 to assist a user in positioning their body in the correct positions for the exercise they are performing. The index markings 26 further allows a user to measure various performance vectors relative to range of motion. For example one exercise may request that a user place their left foot onto the rotary disk 24 with it aligned at the 12 o'clock index marking 26 and then rotate it to the 9 o'clock index marking 26 to perform the exercise. Similarly an exercise may require that a user repetitively rotate between the 12 o'clock position and the two o'clock position. Further when performing various stretching and resistive exercises as will be described in detail below the user stands on the rotary disk 24 such that they must balance their body motions in a manner that resists the naturally induced rotation of the rotary disk 24. For example as a user bends at the knee the foot naturally tends to pronate inducing rotation of the rotary disk 24. The exercise in turn requires that the user resist this rotation as they bend at the knee. This feature provides a much more balanced exercise process while also naturally working the entire set of muscle groups related to the exercise rather than simply isolating a single motion or muscle.

Turning now to FIG. 3 the base portion 12 is depicted in a close view wherein the hinge point 28 for the attachment of the posture bar 14 can be seen. In addition the rotary disk 24 can be seen received in the recess 22 on top of the base portion 12. Index markings 26 can be seen both on the top surface 16 of the base portion 12 as well as on the rotary disk 24 to allow the user to align the rotary disk 24 as necessary. Further hooks 30 can be seen positioned along the front edge of the base portion 12. The hooks 30 are positioned as rigid attachment points for resistance bands pulleys and the like to enhance or supplement the various exercise routines performed using the apparatus 10 of the present invention.

Turning to FIG. 4 for example resistance bands 32 can be seen affixed to the hooks 30 and to a pin 34 on the rotary disk 24. In accordance with the present invention various different mechanism may be employed with the rotary disk 24 to enhance the overall range of features provided. For example the rotary disk 24 may be enhanced with a locking mechanism that can be released to allow a full 360-degrees of rotational movement or engaged to stop the rotary disk 24 from moving at all. In addition the rotary disk 24 may include an internal variable resistance arrangement. This may include extensible resistance bands 32 that are affixed to the hooks 30 that are positioned either under or above the rotary disk 24 or an adjustable band clamp that engages against a braking drum under or above the rotary disk 24 thereby resisting rotation of the rotary disk 24 in an adjustable and variable manner. This arrangement allows the user to have more control over the movement of the disc and also can serve to provide additional resistance that enhances the exercise routine as the user's body must work against the additional resistance. Further the rotary disk 24 may include a mechanical indexing mechanism that allows for a specifically defined rotation. For example a turn and click feature allows the rotary disk 24 to be turned over a limited rotation in both internal and external movement.

In addition to the rotary disk 24 the present invention anticipates that other proprioceptive tools can be inserted into the recess 22 including but not limited to a rocker board similar to a see-saw a ball device or a soft surface. These additional tools assist in enhancing balance while involving various muscle groups in the lower extremities as well as posture related muscles in the back throughout the exercise process.

Turning to FIG. 5 the present invention can be seen to further provide attachment points such as the hooks 30 on the base portion 12 that allow various resistive or constant motion assemblies to be attached. In this regard resistive bands pulleys handles cables and various combinations thereof can be attached that are employed in various different exercises while the user is positioned on the base portion. Resistive bands 32 are employed for constant resistive exercises while a single resistance band 32 may be used in combination with one or more pulley to create variable resistance exercises. Further the pulleys and cables may be arranged in a looped manner that allows a constant motion type exercise.

It can therefore be seen that the present invention provides an exercise and rehabilitation tool that requires the user to employ a full and free range of motion while performing the required exercises. This arrangement allows testing and isolation of certain muscle groups for strength testing while the body is maintained in a correct anatomical position. Further the present invention allows core strengthening in that rather than simply working targeted muscle groups the proprioceptive tools require that broad ranges of muscles be involved in each exercise. For these reasons the instant invention is believed to represent a significant advancement in the art which has substantial commercial merit.

While there is shown and described herein certain specific structure embodying the invention it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An exercise apparatus comprising:

a base portion having a top surface and a receiver thereon;

a posture bar affixed to the base portion and extending upwardly therefrom;

a rotary proprioceptive tool received in said receiver on said base portion;

said upper surface of said base portion and said rotary proprioceptive tool both including a plurality of index markings, said proprioceptive tool being movable relative to said base portion to one of said indexed positions; and a variable resistance mechanism to control rotation of said proprioceptive tool relative to said base portion including hook on said base portion and an attachment point on said proprioceptive tool and selectively removable variable resistance bands that extend between said hooks and said attachment point on said proprioceptive tool.

2. The exercise apparatus of claim 1, wherein said rotary proprioceptive tool is selected from the group consisting of: a soft surface, a rocker board and a rotary disk.

3. The exercise apparatus of claim 1, wherein said rotary proprioceptive tool is a rotary disk that rotates freely relative to said base portion.

4. The exercise apparatus of claim 1, wherein said rotary proprioceptive tool is a rotary disk that has limited rotation relative to said base portion.

5. The exercise apparatus of claim 1, further comprising:

hooks extending from said base portion for receiving exercise accessories.

6. The exercise apparatus of claim 5, wherein said exercise accessories are selected from the group consisting of: resistive bands, pulleys, handles and cables.

7. The exercise apparatus of claim 1, wherein said posture bar is releasably attached to said base portion.

8. The exercise apparatus of claim 1, wherein said posture bar is hingedly attached to said base portion, said posture bar being selectively foldable to a position adjacent the top surface of the base portion.

9. The exercise apparatus of claim 1, wherein a height of said posture bar is adjustable.

* * * * *